US005123801A

United States Patent [19]

O'Daniel

[11] Patent Number: 5,123,801

[45] Date of Patent: Jun. 23, 1992

[54] REFUSE COLLECTING VEHICLE

[76] Inventor: Harold W. O'Daniel, 1018 N. Commercial Blvd., Arlington, Tex. 76017

[21] Appl. No.: 589,448

[22] Filed: Sep. 27, 1990

[51] Int. Cl.[5] ..... B65F 03/00

[52] U.S. Cl. ..... 414/525.1; 414/512; 414/517; 414/525.3; 414/786

[58] Field of Search ..... 414/509, 511, 512, 513, 414/517, 518, 525.1, 525.3, 525.4, 525.5, 525.6, 786, 406, 408; 220/909

[56] References Cited

U.S. PATENT DOCUMENTS

| | | | |
|---|---|---|---|
| 2,837,230 | 6/1958 | Herterich | 414/525.4 X |
| 2,914,205 | 11/1959 | Trubinski | 414/525.4 |
| 3,456,821 | 7/1969 | Pappas et al. | 414/525.4 |
| 3,771,675 | 11/1973 | Herpich et al. | 414/509 |
| 3,921,832 | 11/1975 | Smith | 414/509 |
| 4,113,125 | 9/1978 | Schiller | 414/512 |
| 4,121,725 | 10/1978 | Demanais | 414/525.4 |
| 4,242,953 | 1/1981 | St. Gelais | 414/525.6 X |
| 4,372,726 | 2/1983 | Lutz | 414/517 |
| 4,786,228 | 11/1988 | Mazzochia et al. | 414/525.1 |
| 4,865,227 | 9/1989 | Stephens | 414/489 X |

FOREIGN PATENT DOCUMENTS

| | | | |
|---|---|---|---|
| 0359083 | 3/1990 | European Pat. Off. | 414/525.6 |
| 3537546 | 4/1987 | Fed. Rep. of Germany | 414/512 |
| 0162877 | 2/1980 | Netherlands | 414/525.3 |
| 2212778 | 8/1989 | United Kingdom | 414/511 |

*Primary Examiner*—Robert J. Spar
*Assistant Examiner*—James Keenan
*Attorney, Agent, or Firm*—Charles D. Gunter, Jr.

[57] ABSTRACT

The refuse collecting vehicle of the invention is used for collecting and transporting separate and distinct waste materials. The vehicle includes a vehicle chassis and a storage body mounted on the chassis. The storage body is divided into a plurality of distinct storage chambers, each of the chambers running parallel to the longitudinal axis of the vehicle. The vehicle also includes a tailgate section which is comprised of a plurality of distinct and individually actuable hopper units, each hopper unit having a loading opening which is longitudinally aligned with the respective one of the distinct storage chambers in the storage body for transferring material thereto. Each hopper unit is also pivotally mounted at the rear of the storage body for swinging movement away from the body as material is being discharged therefrom. A separate loading mechanism is provided within each hopper unit for transferring material from the hopper unit, through its loading opening, to its respective longitudinally aligned storage chamber in the storage body.

10 Claims, 5 Drawing Sheets

REFUSE COLLECTING VEHICLE

BACKGROUND OF THE INVENTION

1. Field of the Invention

The present invention relates generally to a refuse collecting vehicle for collecting and transporting separated waste materials, the vehicle being specifically adapted for separating and transporting recyclable materials such as glass, paper and plastic of the type present in domestic refuse.

2. Description of the Prior Art

The recovery of recyclable materials such as paper, plastic and glass from domestic refuse is of increasing concern at the present time. The public is increasingly concerned with the necessity of conserving natural resources and energy. This concern is heightened by the problem of solid waste disposal which has been brought to the public attention in a number of dramatic fashions in recent years.

Although many home owners are concerned with the problem of solid waste disposal and with the depletion of natural resources there is, at the present time, no convenient and economically feasible solution to the problem at hand. Recyclable materials such as papers, plastic and glass are only economically reusable if separated from domestic refuse by suitable sorting and collection techniques. Best results have been achieved in residential areas with a predominant number of single or two-family buildings, i.e., detached and semi-detached house buildings. This type of collection is burdened, however, by high cost, since relatively few buildings are accessed within a given collection distance Although many neighborhood associations have attempted to provide recycling services, these efforts have often required volunteer effort to collect and transport the separated waste materials in private vehicles. The availability of a specially adapted collection vehicle would undoubtedly increase private sector participation in recycling efforts.

One proposed solution to the problem has been a specially constructed trailer having separate waste compartments which open from the side, the trailer being towed behind a conventional refuse collection vehicle. However, the separate trailer compartments were capable of only holding a limited volume of recyclable materials and did not provide a mechanical packer, making such an arrangement impractical for most applications U.S. Pat. No. 2,914,205 and U.S. Pat. No. 4,113,125 both show compartmented refuse collecting vehicles in which the vehicle body has separate collecting chambers for receiving separated recyclable materials However, in both cases, the tailgate section of the vehicle was a unitary member, requiring the use of removeable partitions or other awkward and expensive baffle arrangements for directing the separated recyclable materials into the intended compartments within the vehicle body.

The present invention has as its object to provide a vehicle and method for collecting domestic refuse, allowing separation of the waste materials into separate and distinct recyclable categories and for transporting such recyclable materials to a remote collection point without greatly increasing the labor cost, working time, or expense of the collection operation.

Another object of the invention is to provide such a vehicle having a tailgate section with a plurality of distinct and individually actuable hopper units for transferring separable materials to the vehicle body.

Another object of the invention is to provide a refuse collecting vehicle having a storage body with a plurality of distinct storage chambers for receiving separated refuse materials from the distinct and individually actuable hopper units for transporting the refuse materials to a remote collection site.

Another object of the invention is to provide the distinct storage chambers with individual ejector means for selectively discharging material from each of the distinct storage chambers of the storage body.

SUMMARY OF THE INVENTION

The refuse collecting vehicle of the invention is used for collecting and transporting separated waste materials. The vehicle includes a vehicle chassis having a length and a width, the length of the chassis defining a longitudinal axis for the vehicle. A storage body is mounted on the chassis, the storage body having an interior, a front and a rear. The storage body is divided into a plurality of distinct storage chambers, each of the chambers running parallel to the longitudinal axis of the vehicle. The vehicle also includes a tailgate section which is comprised of a plurality of distinct and individually actuable hopper units, each hopper unit having a loading opening which is longitudinally aligned with a respective one of the distinct storage chambers in the storage body for transferring material thereto. Each hopper unit is also pivotally mounted at the rear of the storage body for swinging movement away from the body as material is being discharged therefrom. Separate loading means are provided within each hopper unit for transferring material from that hopper unit, through its loading opening, to its respective longitudinally aligned storage chamber in the storage body. Individual ejector means are also provided within each storage chamber in the storage body for selectively discharging material from each of the distinct storage chambers.

Additional objects, features and advantages will be apparent in the written description which follows.

DETAILED DESCRIPTION OF THE INVENTION

Figure 1:
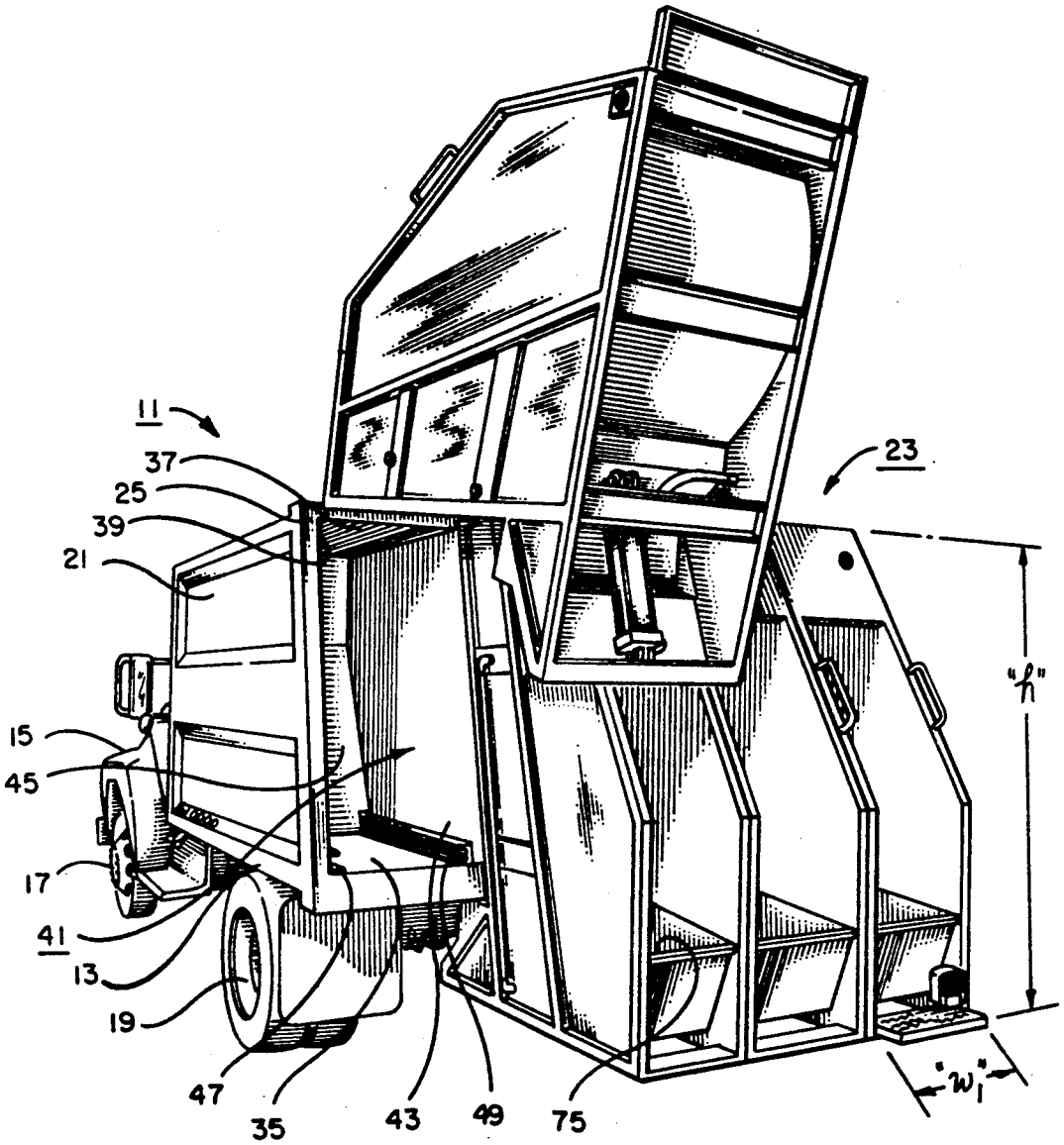
FIG. 1 is a perspective view of the refuse collecting vehicle of the invention with one of the hopper units of the tailgate section in the raised, discharge position.
Figure 5:
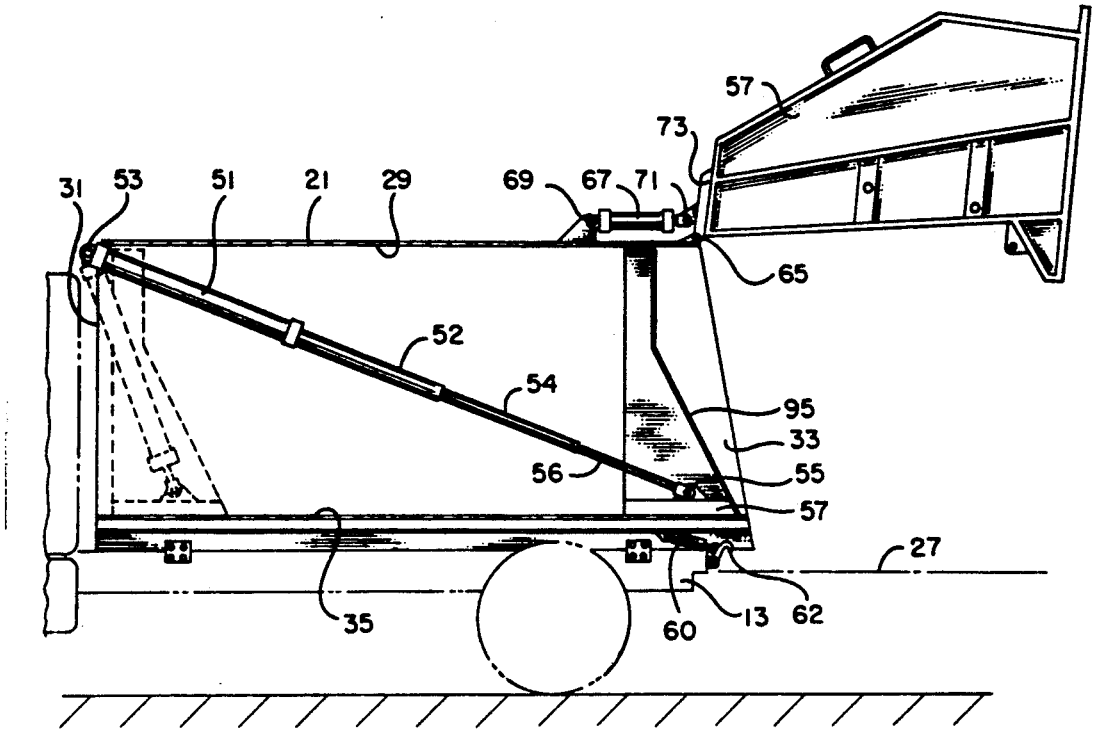
FIG. 5 is a view similar to FIG. 4 showing the next step of the operational cycle of the vehicle in which the tailgate section is pivoted upwardly to the discharge position, allowing discharge of the refuse materials from the storage body.
Figure 6:
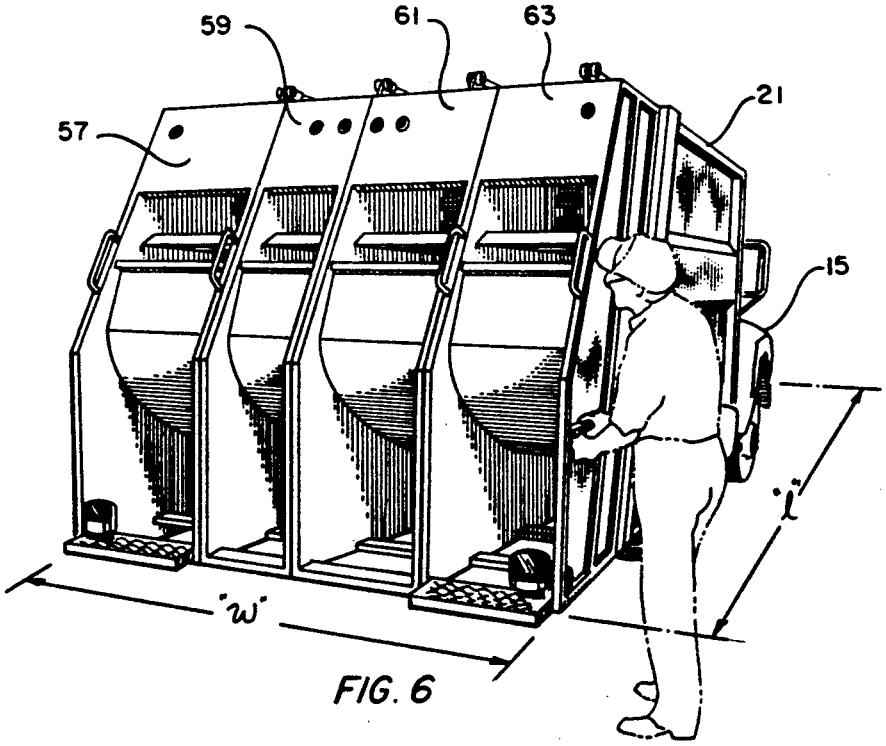
FIG. 6 is a perspective view of the rear of the vehicle of FIG. 1 showing the distinct and individually actuable hopper units with the collection buckets in the loading position.
Figure 7A:
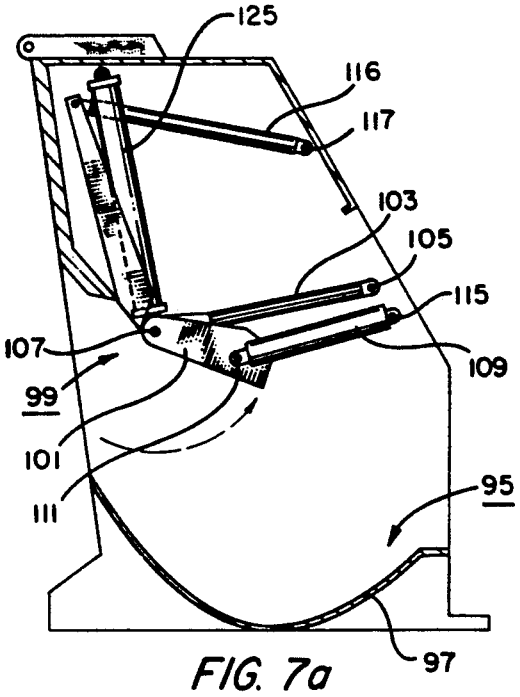
FIG. 7*a* is another embodiment of the loading means of the invention in which the hopper unit has a clam shell configuration and with the scraper blade in the retracted, collecting position.
Figure 7B:
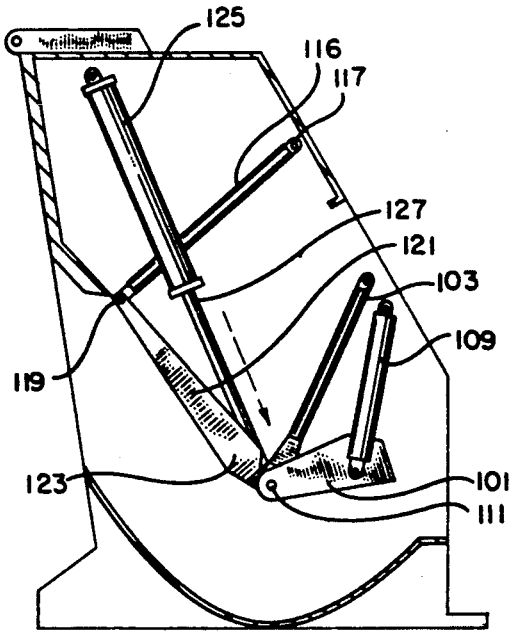
FIG. 7*b* is similar to FIG. 7*a* and shows the next step in the operational sequence in which the scraper blade begins its downward motion to transfer collected material from the hopper unit to a selected storage chamber of the vehicle.
Figure 7C:
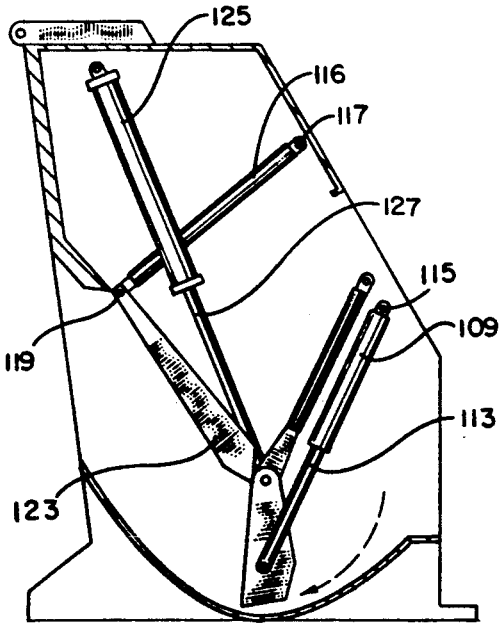
FIG. 7*c* is similar to FIG. 7*b* and shows the continued motion of the scraper blade within the hopper unit.
Figure 7D:
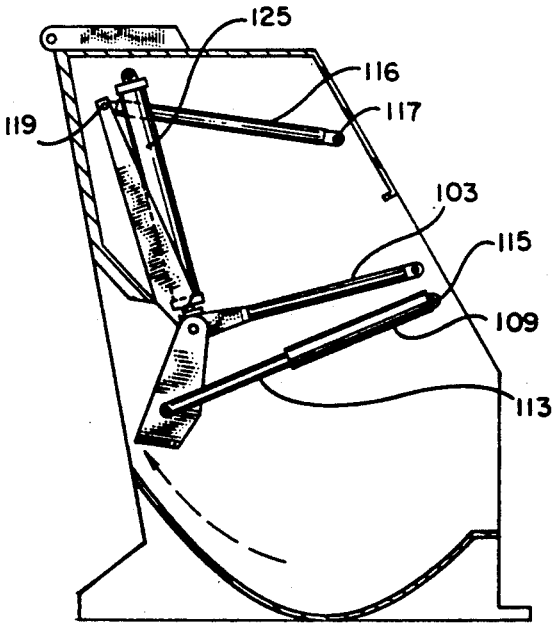
FIG. 7*d* is similar to FIG. 7*c* and shows the scraper blade moving the collected material through the loading opening to the selected storage chamber in the storage body of the vehicle.
Figure 8A:
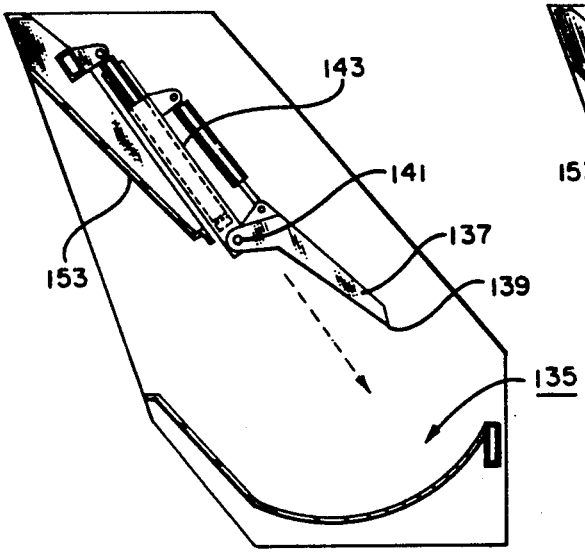
FIGS. 8*a*–8*d* are similar to FIGS. 7*a*–7*c* and show another embodiment of the loading means of the invention.
Figure 8B:
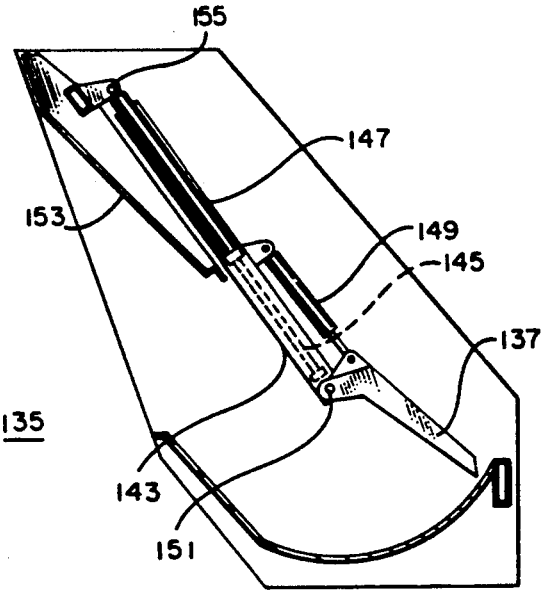
Figure 8C:
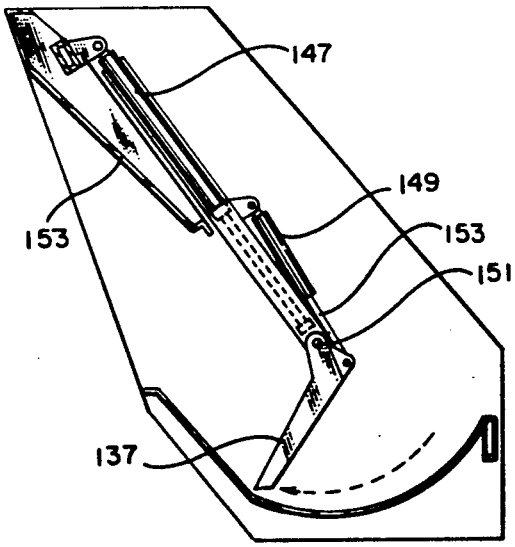
Figure 8D:
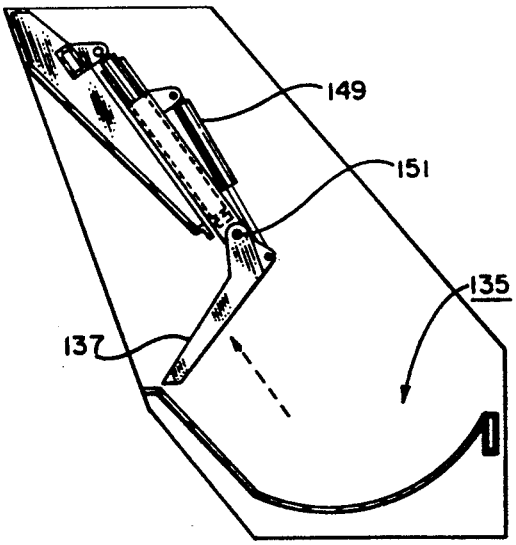

FIG. 1 shows a refuse collecting vehicle of the invention designated generally as 11. The refuse collecting vehicle 11 includes a truck chassis 13, a driving cab 15 and wheel axles 17, 19. The vehicle also includes a storage body 21 having a tailgate section 23 which normally closes the rear 25 of the storage body 21. As best seen in FIGS. 5 and 6, the vehicle chassis has a length "l" and a width "w", the length of the chassis defining a longitudinal axis 27 for the vehicle. The refuse collecting vehicle of the invention is especially adapted for collecting and transported separated, recyclable materials such as paper, plastic and glass.

The storage body 21 (FIG. 5) is fixedly mounted on the chassis 13 and has an interior 29 which is defined by a closed front 31, an open rear 33, a floor 35, a ceiling 37 and interconnecting sidewalls 39 (FIG. 1). The storage body interior is divided into a plurality, in this case 4, distinct storage chambers (chamber 41 shown in FIG. 1) by a series of vertical partitions 43 which are arranged to run from the floor 35 to the ceiling 37 of the storage body interior.

Each distinct storage chamber 41 within the storage body 21 is provided with a hydraulically powered, wedge-shaped ejector panel 45 which runs on parallel tracks 47, 49 provided in the floor 35 of the chamber. As shown in FIG. 5, a hydraulic cylinder 51 having a pivotal point of attachment 53 has an output shaft 55 which is attached to a rear flange 57 of the ejector panel for sliding the ejector panel between the discharge position shown in solid lines in FIG. 5 and the loading or retracted position shown in dotted lines in FIG. 5. The wedge-shaped ejector panel 45 is arranged transversely to the longitudinal axis 27 of the vehicle for discharging material from the respected distinct storage chamber 41.

The tailgate section 23 is comprised of a plurality of distinct and individually actuable hopper units 57, 59, 61, 63. Each hopper unit has a vertical height "h" and a horizontal width "wl" (see FIG. 1), the vertical height being at least twice the horizontal width. Preferably, the vertical height "h" is about 4 to 6 times the width to accommodate the collection and transportation of 3 or more separate and distinct materials without increasing the overall width of the vehicle.

As shown in FIG. 5, each hopper unit 57 is pivotally mounted at the top rear 25 of the storage body 21 on a pivot axis 65 so that the hopper unit 57 is pivotable between a raised, discharge position shown in FIG. 5 and the lowered, collecting and loading position shown in FIG. 6. The hopper unit 57 can be conveniently pivoted by means of one or more hydraulic cylinders 67 mounted at a pivot point 69 to the storage body and having an output shaft 71 attached to the upper frame 73 of the hopper unit 57.

As shown in FIG. 1, each hopper unit has a receiving area 75 for receiving recyclable material, the receiving area being located below the mid-point of the vertical height "h" of each hopper unit. Each hopper unit also has a loading opening 77 (FIG. 4) located above the receiving area 75 which is longitudinally aligned with a respective one of the distinct storage chambers 41 in the storage body 21 for transferring material thereto. In the embodiment of the invention shown in FIGS. 2–6, the receiving area 75 is a swinging bucket 79 attached to the bottom rear of the storage body 21 along a pivot axis 81 and pivotable between the collecting position shown in FIG. 3 and the loading position shown in FIG. 4 by means of a hydraulic cylinder 83. The swinging bucket 79 forms a portion of a separate loading means within each hopper unit for transferring material from that hopper unit, through its loading opening 77 to its respective longitudinally aligned storage chamber 41 in the storage body 21.

In the embodiment of the invention shown in FIGS. 2–6, the loading means also includes a scraper blade 85 which is pivotally mounted between the vertically connecting sidewalls of the hopper unit above the bucket 79 for scrapping the contents of the bucket through the loading opening 77 into the respective one of the distinct storage chambers in the storage body. In this case, the scraper blade 85 has an actuating cylinder 87 which is attached at a vertical point 89 above the collecting bucket 79, the cylinder 87 having an output shaft 91 which is pivotally connected to the bottom wall 93 of the scraper blade for moving the blade between the rest position shown in dotted lines in FIG. 3 and the loading position shown in solid lines in FIG. 3.

Figure 2:
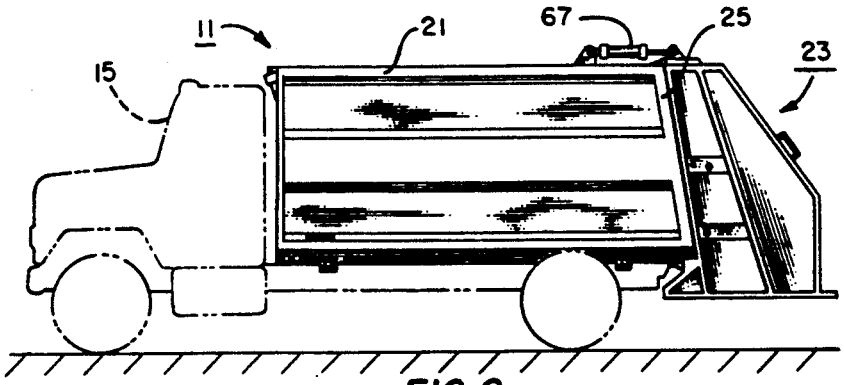
FIG. 2 is a side view of the vehicle of FIG. 1 showing the vehicle cab and chassis in phantom lines and showing the tailgate section in the lowered, collecting position.

The operation of the refuse collecting vehicle of the invention can be explained with reference to FIGS. 2–6. FIG. 2 shows the normal transport position of the vehicle 11 with the tailgate section 23 in the lowered, collecting position and the swinging buckets 75 in the position shown in FIG. 3. The separate, recyclable materials are received within the swinging buckets 75 with the buckets in the lowered position shown in FIG. 3. When it is desired to transfer the collected material from a bucket 75 to its respective separate and distinct chamber 41, the scraper blade 85 is first moved from the lowered position shown in solid lines in FIG. 3 to the position shown in dotted lines by retracting the output shaft 91 of the hydraulic cylinder 87. In the next step in the operating cycle, the hydraulic cylinder 83 is actuated causing the bucket 75 to move from the lowered, collecting position shown in dotted lines in FIG. 4 to the loading position shown in solid lines. The scraper blade 85 is then moved from the position shown in solid lines in FIG. 4 to the position shown in dotted lines to thereby scrape the contents of the bucket 75 through the loading opening 77 into the respective one of the distinct storage chambers 41 provided in the storage body 21.

Figure 3:
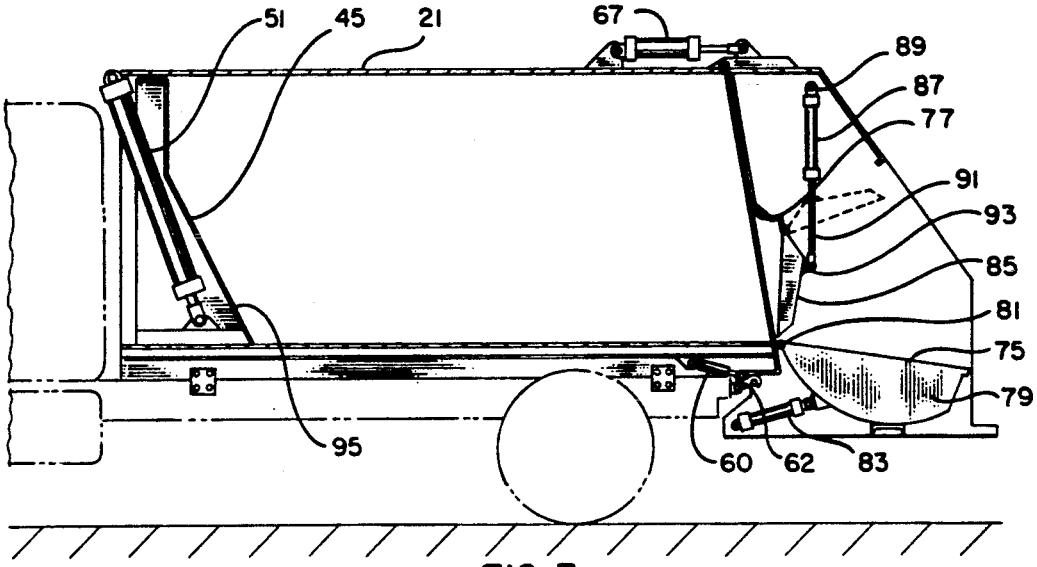
FIG. 3 is a simplified, partially sectioned view of the vehicle and tailgate section showing the preferred loading means with the scraper blade thereof being shown in the lowered position, the raised position thereof being indicated in dotted lines.
Figure 4:
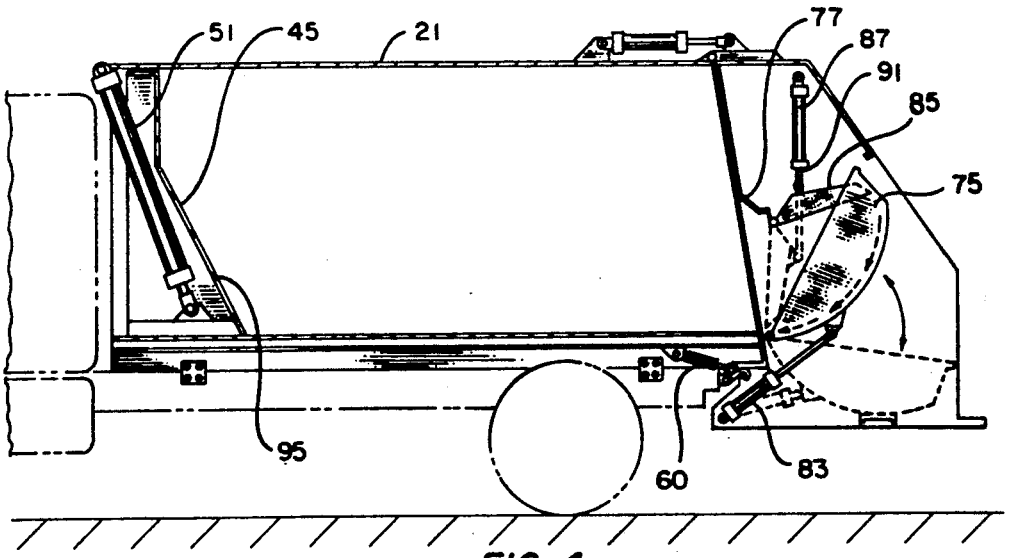
FIG. 4 is a view similar to FIG. 3 showing the next step in the operational cycle in which the collection bucket of the tailgate section is moved to the loading position, the collecting position being indicated in dotted lines.

The wedge-shaped ejector panel 45 is shown in the fully retracted, loading position in FIGS. 3 and 4. Alternatively, it will be understood that the ejector panel 45 can be moved to the position shown in FIG. 5 and the hydraulic pressure released on the cylinder 51 prior to beginning the loading operation so that the front wall of the ejector panel 45 provides a predetermined resistance to facilitate packing of the materials being loaded. It will also be understood that each of the hopper units 57, 59, 61, 63 is individually actuable through the operational cycle previously described so that one or more of the hopper units which is filled with collected material can be loaded into its respective chamber.

FIGS. *7a–7c* illustrate another embodiment of the loading means of the invention. As shown in FIG. *7a*, the hopper unit can be of the clam-shell design, having a receiving area 95 which, in this case, is a concave floor region formed between the vertically connecting sidewalls of the hopper unit. The loading means further includes a segmented scraper 99 having a scraper blade 101 which is pivotable about a pivot linkage 103 which is attached at one end 105 at a pivot point within the hopper interior and at an opposite end 107 to the blade upper extent. The blade lower extent is pivotally attached to a hydraulic cylinder 109 at a pivot point 111, the hydraulic cylinder having an output shaft 113 and a pivotal attachment point 115 within the hopper interior. A second pivot linkage 116 is attached at a pivot point 117 within the hopper interior at one end and at a second pivot point 119 to a scraper element 121, the scraper element 121 having a lower extent 123 which is pivotally attached to the scraper blade 101 at the pivot point 111. The operation of this "clam shell" type loading means will not be described.

FIG. *7a* shows the collecting position with recyclable materials being received within the concave recess formed by the floor region 97 of each individual hopper. The scraper blade 101 is in the raised, collecting position. The output shaft 127 of the cylinder 125 is then extended, causing the scraper element 121 to be pivoted downwardly and causing the scraper blade 101 to move to the position shown in FIG. *7b*. The output shaft 113 of the hydraulic cylinder 109 is then extended causing the blade 101 to move in a scrapping motion through the concave region of the receiving area of the hopper unit, as shown in FIG. *7c*. The retraction of the output shaft 127 of cylinder 125 completes the loading cycle, moving the scraper blade to the loading position shown in FIG. *7d*.

FIGS. *8a–8d* illustrate another embodiment of the loading means of the invention. The hopper is again of the clam shell design, having a receiving area 135. The receiving area 135 is a concave region formed between the vertically connecting sidewalls of the hopper unit. In the embodiment of FIG. *8a*, the loading means includes a scraper blade 137 having a free end 139 and a pivoting end 141. The pivoting end 141 is carried on an extension sleeve 143. The extension sleeve 143 is connected to the output shaft 145 (shown in the extended position in FIG. *8b*) of an extension cylinder 147, for extending and retracting the extension sleeve 143 and scraper blade 137. A pivot cylinder 149 is carried on the extension sleeve 143 for pivoting the scraper blade 137 about a pivot point 151. The extension cylinder 147 is attached to a mounting plate 153 at an attachment point 155.

FIG. *8a* shows the collecting position with recyclable materials being received within the concave recess indicated as 135. The scraper blade 137 is in the raised, collecting position. The output shaft 145 of the extension cylinder 147 is then extended, causing the scraper blade 137 to move to the position shown in FIG. *8b*. The output shaft 153 of the pivot cylinder 149 is then extended, causing the scraper blade to pivot about the pivot 151 to the position shown in FIG. *8c*. Retraction of the extension cylinder output shaft 145 causes the scraper blade 137 to move in a scraping motion through the concave region of the receiving area of the hopper unit, as shown in FIG. *8d*. Retraction of the output shaft 153 of the pivot cylinder 149 completes the cycle, moving the scraper blade to the position shown in FIG. *8a*.

The discharge cycle of the device will now be described. FIGS. 3 and 4 show the ejector panel 45 in the fully loaded position, as were the respective chamber 41 has been packed with collected material In order to discharge collected material from the respective chamber 41, the hopper unit 57, 59, 61, 63 is pivoted from the lowered, collecting position shown in FIG. 2 to the raised discharge position shown in FIG. 5. This is accomplished by first actuating the latch cylinder (60 in FIG. 3) which pivots hook 62 off the engagement region provided on the hopper unit. The cylinder 51 is then actuated, causing the telescoping portions 52, 54, 56 of the output shaft to extend to the discharge position shown in FIG. 5, thereby sliding the ejector panel 45 along the tracks 47, 49 to discharge the collected material from the open rear of the storage body. The latch cylinder 60 and hook 62 are shown in the unlatched position in FIG. 5. It will be understood that one or more of the hopper units can be individually actuated, or all of the units may be simultaneously actuated to discharge the collected material.

An invention has been provided with several advantages. The refuse collecting vehicle of the invention provides a convenient means for collecting and transporting separate and distinct recyclable materials. Each type of material is segregated within a separate and distinct collecting chamber in the storage body of the vehicle. A unique tailgate arrangement having individually actuable hopper units provides a convenient and efficient receiving area for the material to be collected. The loading means of the invention quickly and efficiently transfers the collected material from the receiving area to the respective storage chamber. It is not necessary that removeable partitions be installed and removed on the storage body or that internal baffles, and the like, be utilized to properly channel the collected materials into separate and distinct storage chambers. Each of the separate collecting chambers also has an individually actuable ejector panel for discharging collected material.

While the invention has been shown in only one of its forms, it is not thus limited but is susceptible to various changes and modifications without departing from the spirit thereof.

I claim:

1. A refuse collecting vehicle for collecting and transporting separated, recyclable material, the vehicle comprising:

a vehicle chassis having a length and a width, the length of the chassis defining a longitudinal axis for the vehicle;

a storage body mounted on the chassis, the storage body having an interior defined by a closed front, an open rear, a floor, a ceiling and interconnecting sidewalls, the storage body interior being divided into a plurality of distinct storage chambers by a series of vertical partitions arranged to run from floor to ceiling within the interior of the storage body, each of the distinct storage chambers running parallel to the longitudinal axis the vehicle;

a tailgate section comprised of a plurality of distinct and individually actuable hopper units, each hopper unit having a loading opening which is longitudinally aligned with a respective one of the distinct storage chambers in the storage body for transferring material thereto, each hopper unit also being pivotally mounted at the rear of said storage body for swinging movement away from said body as material is being discharged therefrom, and wherein each hopper unit is independently pivotable relative to each of the other said hopper units mounted at the rear of said storage body;

separate loading means within each hopper unit for transferring material from that hopper unit, through its loading opening, to its respective longitudinally aligned storage chamber in the storage body.

2. The refuse collecting vehicle of claim 1, wherein each hopper unit is pivoted about the rear of the storage body by means of an individually actuable hydraulic cylinder mounted between the storage body and the hopper unit.

3. The refuse collecting vehicle of claim 2, wherein the loading means is a swinging bucket loader.

4. The refuse collecting vehicle of claim 2, wherein 2 the loading means is a clam shell loader.

5. A refuse collecting vehicle for collecting and transporting separated, recyclable material, the vehicle compiling:

a vehicle chassis having length and a width, the length of the chassis defining a longitudinal axis for the vehicle;

a storage body mounted on the chassis, the storage body having an interior defined by a closed front, an open rear, a floor, a ceiling and interconnecting sidewalls, the storage body inferior being divided into a plurality of distinct storage chambers ba series of vertical partitions arranged to run from floor to ceiling within the interior of the storage body, each of the distinct storage chambers running parallel to the longitudinal axis of the vehicle;

a tailgate section comprised of a plurality of distinct and individually actuable hopper units, each hopper unit having a vertical height and a horizontal width, the vertical height being at least two the horizontal width, each hopper unit having a receiving area for receiving recyclable material which is located below the mid-point of the vertical height of the hopper unit, each hopper unit having a loading opening above the receiving area which is longitudinally aligned with a respective one of the distinct storage chambers in the storage body for transferring material thereto, each hopper unit also being pivotally mounted at the rear of said storage body for swinging movement away from said body as material is being discharged therefrom, and wherein each hopper unit is independently pivotable relative to each of the other said hopper units mounted at the rear of said storage body;

separate loading means within each hopper unit for transferring material from that hopper unit, through its loading opening, to its respective longitudinally aligned storage chamber in the storage body.

6. The refuse collecting vehicle of claim 5, wherein each hopper unit has a top, a bottom and vertically connecting sidewalls, the receiving area including a swinging bucket which is pivotally mounted between the vertically connecting sidewalls, the swinging bucket having an open top which is located below the mid-point of the vertical height of the hopper unit, and wherein the loading means includes a scraper blade pivotally mounted between the vertically connecting sidewalls of the hopper unit above the bucket for scraping the contents of the bucket through the loading opening into the respective one of the distinct storage chambers in the storage body.

7. The refuse collecting vehicle of claim 5, wherein each hopper unit has a top, a bottom and vertically connecting sidewalls, the receiving area comprising a concave region of the hopper unit bottom, and wherein the loading means includes a scraper blade pivotally mounted between the vertically connecting sidewalls of the hopper unit above the concave region of the hopper unit bottom for scraping the contents of the hopper unit bottom through the loading opening into the respective one of the distinct storage chambers in the storage body.

8. The refuse collecting vehicle of claim 5, wherein each distinct storage chamber of the storage body is provided with a hydraulically powered, wedge-shaped ejector panel arranged transversely to the longitudinal axis of the vehicle for discharging material from each distinct storage chamber of the storage body when the respective hopper unit has been swung away from the body.

9. A method of collecting and transporting separated, recyclable material in a specially designed refuse collection vehicle, the method comprising the steps of:

providing a storage body on a vehicle chassis having an interior defined by a closed front, an open rear, a floor, a ceiling and interconnecting sidewalls, the storage body interior being divided into a plurality of distinct storage chambers ba series of vertical partitions arranged to run from floor to ceiling within the interior of the storage body, each of the distinct storage chambers running parallel to the longitudinal axis of the vehicle;

mounting a tailgate section on the storage body, the tailgate section being comprised of a plurality of distinct and individually actuable hopper units, each hopper unit having a vertical height and a horizontal width, the vertical height being at least twice the horizontal width, each hopper unit being provided with a receiving area for receiving recyclable material which is located below the mid-point of the vertical height of the hopper unit, each hopper unit also being provided with a loading opening above the receiving area which is longitudinally aligned with a respective one of the distinct storage chambers in the storage body for transferring material thereto, each hopper unit also being pivotally mounted at the rear of said storage body for swinging movement away from said body as material is being discharged therefrom, and wherein each hopper unit is independently pivotable relative to each of the other said hopper units mounted at the rear of said storage body;

providing separate loading means within each hopper unit for transferring material from that hopper unit, through its loading opening, to its respective longitudinally aligned storage chamber in the storage body;

collecting and depositing distinct recyclable materials within at least two of the receiving areas of the distinct and individually actuable hopper units.

actuating the separate loading means for at least one of the distinct and individually actuable hopper units to thereby transfer the distinct recyclable material to a selected one of the distinct and separate storage chambers in the storage body of the vehicle.

10. The method of collecting and transporting separated, recyclable material in a specially designed refuse collection vehicle of claim 9, further comprising the steps of:

providing each distinct storage chamber of the storage body with a hydraulically powered, wedge-shaped ejector panel arranged transversely to the longitudinal axis of the vehicle for discharging material from each distinct storage chamber of the storage body when the respective hopper unit has been swung away from the body; and actuating the respective ejector panel to discharge the distinct recyclable material from the selected distinct and separate storage chamber in the storage body of the vehicle.

* * * * *